US005421659A

United States Patent [19]

Liang

[11] Patent Number: 5,421,659

[45] Date of Patent: Jun. 6, 1995

[54] KEYBOARD HOUSING WITH CHANNELS FOR DRAINING SPILLED LIQUID

[76] Inventor: Hui-Hu Liang, No. 3 Pao Chi Lane, Chuang Ya Tsun, Siu Shui Hsiang, Changwa Hsien, Taiwan, Prov. of China

[21] Appl. No.: 302,058

[22] Filed: Sep. 7, 1994

[51] Int. Cl.[6] ..... B41J 5/10

[52] U.S. Cl. ..... 400/472; 200/5 A; 200/306; 235/145 R; 400/693

[58] Field of Search ..... 400/472, 473, 691, 693; 341/21-23; 345/168; 200/5 A, 5 R, 302.1, 302.2, 306, 512-517; 235/145 R

[56] References Cited

U.S. PATENT DOCUMENTS 5,172,805 12/1992 Gumb ..... 200/5 A 5,180,237 1/1993 Chen ..... 400/479

*Primary Examiner*—David A. Wiecking
*Assistant Examiner*—Steven S. Kelley
*Attorney, Agent, or Firm*—Bacon & Thomas

[57] ABSTRACT

A keyboard includes a body having a number of depressions formed in the upper portion for collecting water, a-number of channels extend upward from the depression for slidably receiving buttons. A base is secured to bottom of the body and a casing is secured to bottom of the base. A number of conduits extend downward from the depression for communicating the depressions with the casing for allowing water collected in the depressions to flow into the casing so as to prevent water from flowing into the circuit board received between the body and the base.

1 Claim, 3 Drawing Sheets

KEYBOARD HOUSING WITH CHANNELS FOR DRAINING SPILLED LIQUID

BACKGROUND OF THE INVENTION

1. Field of the Invention

The present invention relates to a keyboard, and more particularly to a keyboard assembly having a water proof effect.

2. Description of the Prior Art

Typical keyboards do not include water proof effect such that typical keyboards may be easily damaged when water is inadvertently splashed onto the keyboards.

The present invention has arisen to mitigate and/or obviate the afore-described disadvantages of the conventional keyboards.

SUMMARY OF THE INVENTION

The primary objective of the present invention is to provide a keyboard assembly which includes a water proof configuration for protecting the keyboard from being damaged by water.

In accordance with one aspect of the invention, there is provided a keyboard assembly comprising a keyboard body including at least one depression formed therein for collecting water, a plurality of channel means extended upward from the depression, at least one conduit extended downward from the depression and communicating with the depression for allowing outward flow of the water collected in the depression, a base secured to bottom of the keyboard body and including at least one hole formed therein for engaging with the conduit, and a casing secured to bottom of the base for collecting water from the conduit, water collected in the depression being guided to flow into the casing and being prevented from flowing into a space formed between the keyboard body and the base.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
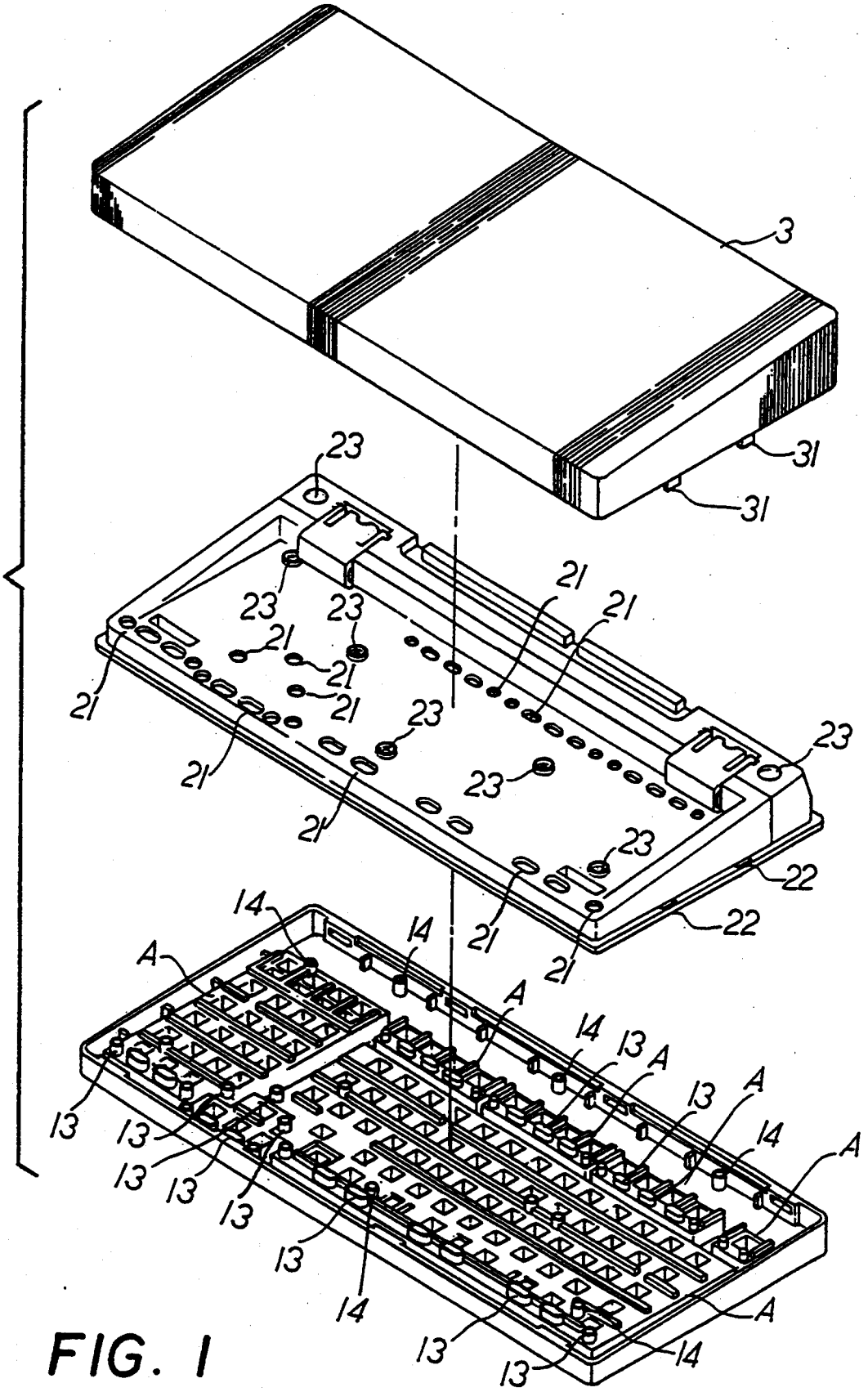
FIG. 1 is an exploded view as viewing from the bottom of a keyboard assembly in accordance with the present invention.
Figure 3:
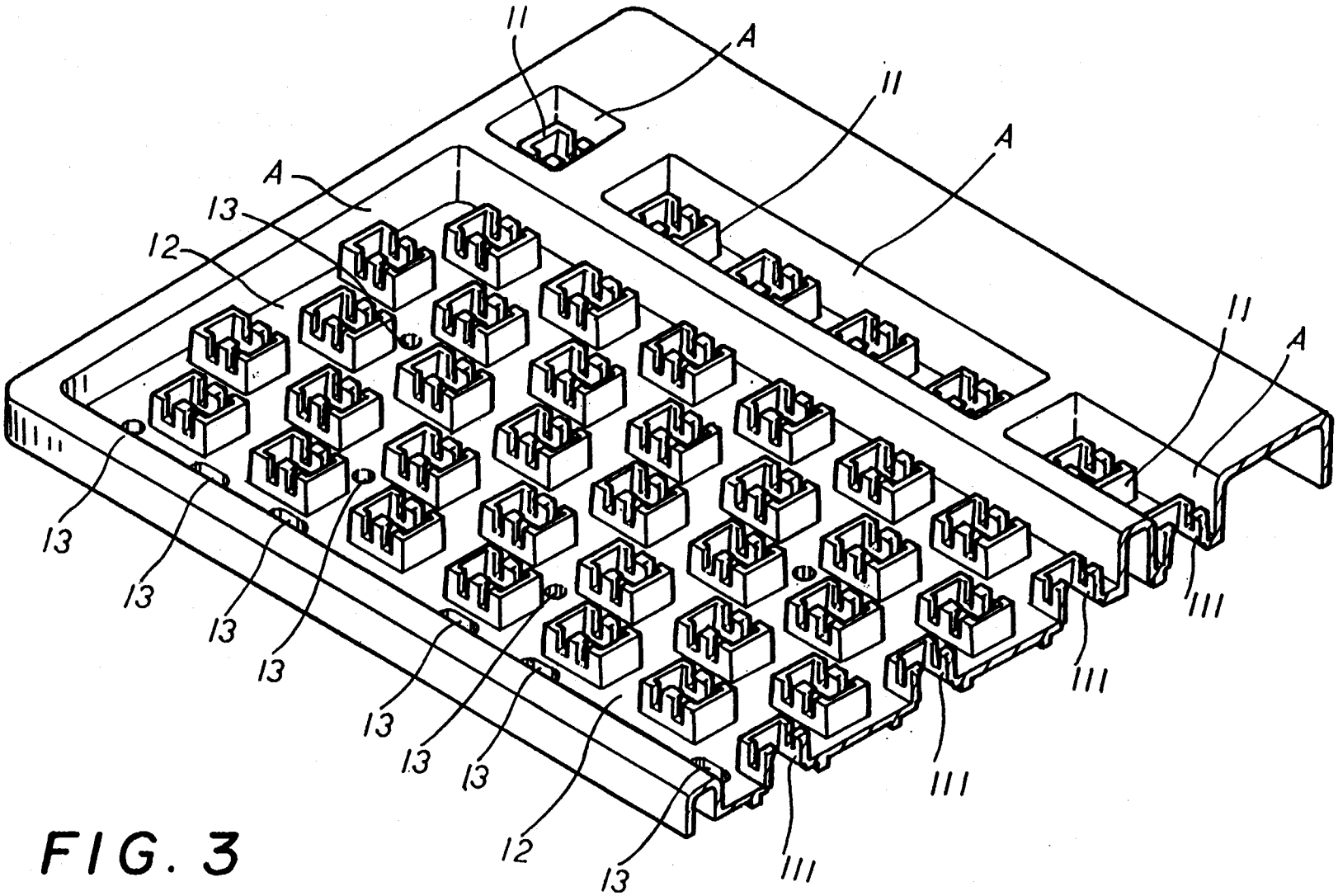
FIG. 3 is a perspective view of a keyboard body, in which part of the keyboard body is cut off.

Referring to the drawings, a keyboard assembly in accordance with the present invention comprises a keyboard body 11 including a number of sections A formed therein, each of the sections A includes a depression formed in the upper portion for collecting water, best shown in FIG. 3. A number of seats or channels 11 are provided in the depressions of the sections A for slidably receiving press buttons. The channels 11 are extended upward from the depressions A so as to form water passages 12 within the depressions A. The depressions of the sections A each includes a number of conduits 13 extended downward and communicating with the depressions A for allowing water to flow out of the depressions. Each of the channels 11 includes a wall member 111 for preventing water from entering into the channels 11. The keyboard body 1 includes a number of stubs 14 extended downward from the bottom thereof, best shown in FIG. 1. It is preferable that the keyboard body is disposed with suitable slope such that the water collected in the depressions may flow to the lowest portion of the depressions A, and the conduits 13 are located in the lowest portion of the depressions A.

Figure 2:
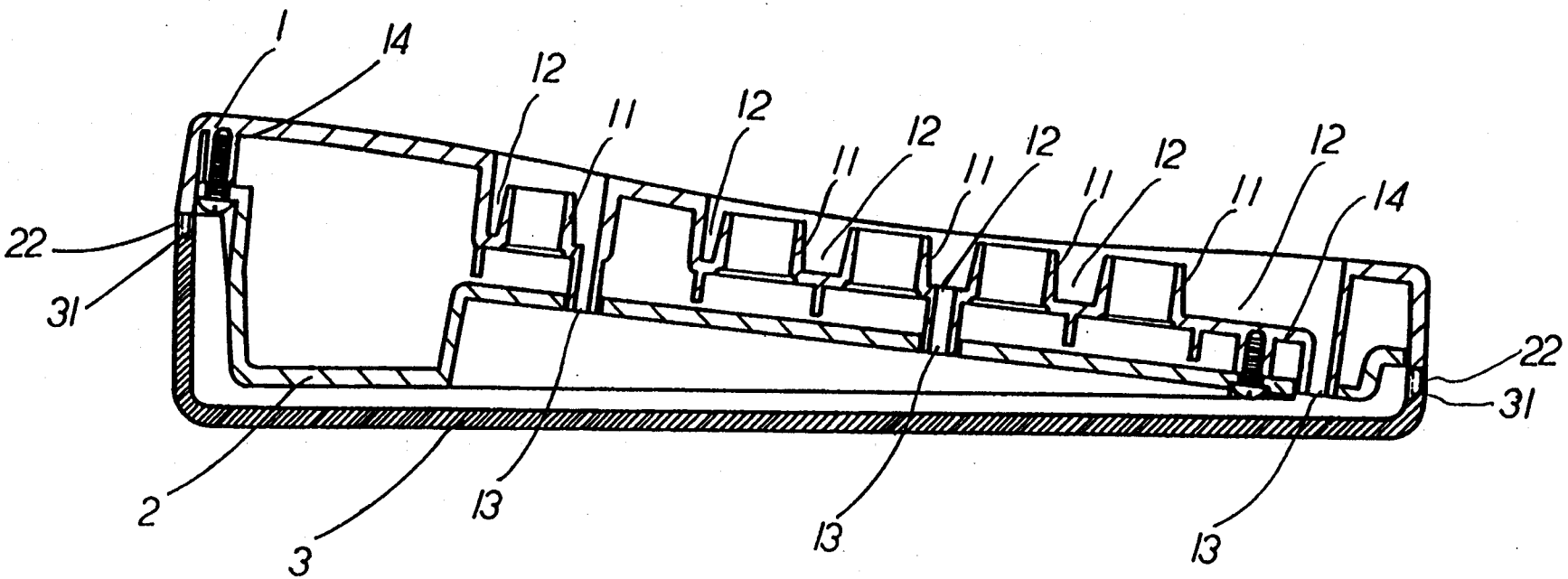
FIG. 2 is a cross sectional view of the keyboard assembly.

A base 2 is secured to the bottom of the keyboard body 1 and includes a number of holes 21 formed therein for engaging with conduits 13, best shown in FIG. 2. A number of screw holes 23 are formed in the base 2 for engaging with a number of fastening means which are engaged with the stubs 14 so as to secure the base 2 to the keyboard body 1. The base 2 includes a number of openings 22 formed in the peripheral portion for engaging with engaging means or hook means 31 of a casing 3 such that the casing 3 may be secured to the base 2. Typical electric boards are disposed between the keyboard body 1 and the base 2, and the buttons are engageable with the electric board for entering information into computers, for example.

It is to be noted that the channels 11 will be suitably covered by the buttons and the water collected in the depressions of the keyboard body 1 may flow into the casing 3 via the conduits 13, such that water is prevented from entering into the space for receiving electric boards, i.e., the space formed between the keyboard body 1 and the base 2.

Accordingly, the keyboard assembly in accordance with the present invention includes a configuration that has water proof effect so as to prevent water from damaging the electric boards of keyboards.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A keyboard assembly comprising:

a keyboard body including at least one depression formed therein for collecting water, a plurality of channel means extended upward from said depression, at least one conduit extended downward from said depression and communicating with said depression for allowing outward flow of said water collected in said depression, a base secured to bottom of said keyboard body and including at least one hole formed therein for engaging with said conduit, and a casing secured to bottom of said base for collecting water from said conduit, water collected in said depression being guided to flow into said casing and being prevented from flowing into a space formed between said keyboard body and said base.

* * * * *